US011189939B2

(12) United States Patent
Nguyen et al.

(10) Patent No.: US 11,189,939 B2
(45) Date of Patent: Nov. 30, 2021

(54) DUAL-POLARIZED WIDE-BANDWIDTH ANTENNA

(71) Applicant: VIETTEL GROUP, Ha Noi (VN)

(72) Inventors: Hoang Linh Nguyen, Ha Noi (VN); Thai Binh Nguyen, Ha Noi (VN); Manh Linh Nguyen, Ha Noi (VN)

(73) Assignee: VIETTEL GROUP, Ha Noi (VN)

( * ) Notice: Subject to any disclaimer, the term of this patent is extended or adjusted under 35 U.S.C. 154(b) by 0 days.

(21) Appl. No.: 16/667,910

(22) Filed: Oct. 30, 2019

(65) Prior Publication Data

US 2020/0136272 A1 Apr. 30, 2020

(30) Foreign Application Priority Data

Oct. 30, 2018 (VN) ..... 1-2018-04856

(51) Int. Cl.

| | |
|---|---|
| ***H01Q 1/42*** | (2006.01) |
| ***H01Q 21/28*** | (2006.01) |
| ***H01Q 25/04*** | (2006.01) |
| ***H01Q 11/10*** | (2006.01) |
| ***H01Q 1/36*** | (2006.01) |
| *H01Q 21/24* | (2006.01) |

(52) U.S. Cl.

CPC ..... *H01Q 21/28* (2013.01); *H01Q 1/36* (2013.01); *H01Q 11/105* (2013.01); *H01Q 25/04* (2013.01); *H01Q 21/24* (2013.01)

(58) Field of Classification Search

CPC ..... H01Q 21/28; H01Q 25/04; H01Q 11/105; H01Q 1/36; H01Q 21/24; H01Q 9/065; H01Q 9/285; H01Q 21/08; H01Q 1/246

See application file for complete search history.

(56) References Cited

U.S. PATENT DOCUMENTS

2003/0034920 A1* 2/2003 Lee ..... H01Q 21/065 343/700 MS
2011/0043424 A1* 2/2011 Lee ..... H01Q 9/285 343/816
2015/0303576 A1* 10/2015 Latrach ..... H01Q 9/0407 343/700 MS

FOREIGN PATENT DOCUMENTS

JP 2009130451 A * 6/2009

OTHER PUBLICATIONS

You-Huo Huang, "Compact and Wideband Dual-Polarized Antenna With High Isolation for Wireless Communication", Progress In Electromagnetics Research Letters, vol. 38, 171-180, 2013, pp. 171-180. (Year: 2013).*

* cited by examiner

*Primary Examiner* — Dieu Hien T Duong
(74) *Attorney, Agent, or Firm* — Patenttm.us

(57) ABSTRACT

The invention relates to a low profile antenna, operating over a wide range of frequencies. The dual-polarized wideband antenna consists of: radiating elements, ground plane, metallic walls, coaxial cables, split-ring slots. The antenna is fed by coaxial cables at feed points, which are surrounded by split-ring slots. The antenna can be utilized as an element in an array to provide particular radiation pattern.

17 Claims, 3 Drawing Sheets

DUAL-POLARIZED WIDE-BANDWIDTH ANTENNA

FIELD OF THE INVENTION

This invention relates to a low-profile dual-polarized wideband antenna. The polarization diversity allows the antenna to simultaneously operate on two independent channels, which is suitable for detecting wideband signals. Due to the low-profile feature, many antennas can be integrated together to become an array for radiation-pattern synthesis. Therefore, the antenna has enormous potential for both civil and military applications.

DESCRIPTION OF THE RELATED ART

An antenna is an integral part for any wireless communication system. Depending on each system, the antenna can work in receiving or transmitting mode or both. In transmitting mode, electromagnetic waves are fed into the antenna where they are focused and sent to assigned directions. In receiving mode, the electromagnetic waves in free space are captured by the antenna and guided to the receiving system for demodulation and analysis. As recent wireless communication systems require higher data rates, the demands on wideband antennas thus become more considerable.

For receiving and transmitting signal, an antenna is required to have a low reflection coefficient that is determined as the ratio of reflected power to the incident power when the antenna is modeled as a one-port network. A small reflection coefficient ensures a high power provided from the system to the antenna at transmitting mode and vice versa at receiving mode. The reflection coefficient is calculated by referring to the characteristic impedance of the system (denoted by $Z_o$). $Z_o$ is typically chosen of 50Ω, but can be varied on each system.

Each antenna can transmit and receive in certain directions, thus its radiation pattern needs to be satisfied the system requirements. The radiation pattern describes how the antenna radiates in different angles. Almost antennas are passive components, they do not consume power, by means of the reciprocity theorem, the receiving and transmitting capabilities are equivalent. For the radar systems, the antennas always operate in the large range of angles, requiring high effective apertures.

An antenna is considered as a wideband one if it has a high fractional bandwidth that is defined as the following formula:

$$\%\ BW = \frac{f_{max} - f_{min}}{f_{max} + f_{min}} \times 2 \times 100\%$$

where $f_{max}$ and $f_{min}$ are respectively the lowest and highest frequencies at which the reflection coefficients are lower than a desired value (ex. −10 dB). At very high frequencies, the radiation pattern of a broadband antenna is usually changed, hence the practical bandwidth is smaller than what derives from the above formula.

The first solution for communication by electromagnetic waves is to employ the dipole antenna. However, this kind of antenna has small bandwidth because its resonant frequency is proportional to the physical dimensions. The most popular dipole has the length of a half wavelength at the resonant frequency. In an attempt to overcome the bandwidth challenge, many dipole antennas are developed by creating more half wavelength segments to have more resonant frequencies. Another technique is to use two orthogonal dipole elements for generating dual polarization such as foursquare and four-point antennas (as shown in S-Y. Suh, W. L. Stutzman, W. A. Davis, "Low-profile, dual-polarized broadband antennas", *IEEE Antennas and Propagation Society Symposium. Digest. Held in conjunction with USNC/CNC/URSI North American Radio Sci. Meeting* (Cat. No.03CH37450), Columbus, Ohio, 2003, pp. 256-259 vol.2.) despite of their small bandwidths.

SUMMARY OF THE INVENTION

It is therefore an embodiment of the present invention to provide an antenna structure which is suitable for radar and communication applications.

To this end, the invention provides a flower-shaped wide-bandwidth antenna with two orthogonal pair of radiating elements. The design is a low-profile antenna well-suited for creating an antenna array with a suitable radiation pattern.

The antenna structure consists of: radiating elements 102, ground plane 103, metallic walls 104; coaxial cables 105, split-ring slots 106. The components are configured in a particular fashion that:

Radiating elements 102 are metalized flower-shaped patterns etched on a top face of a substrate 101, which has low dielectric constant and loss. The flower-shaped pattern is formed as a cruciform configuration with 4 petals, each petal having a similar, non-rectangular shape, as may be observed in FIGS. 1A, 1B, 2 and 5, for example. This printed circuit board is placed above the ground plane 103 with a height of a quarter wavelength at the centre frequency of the operating bandwidth.

In order to maintain the radiation pattern of the antenna over the working band, especially at the high bound, a metallic cavity is added in the space between the printed circuit board and the ground plane. The radiating elements 102 are fed by the coaxial cable 105. Around the feeding points, parts of the elements 102 are removed forming the split-ring slots 106 providing more inductance to cancel out intrinsic capacitance of the elements 102. As a result, the antenna reflection coefficient becomes lower, obtaining an improved fractional bandwidth of 75%. The antenna can be simultaneously fed to operate in two independent channels suitable for tracking wideband signals.

In another fashion, due to its low profile, many antennas can be employed to form an array providing more gain to transmitting or receiving systems.

DETAILED DESCRIPTION OF THE INVENTION

The following describes the invention with explanations and images.

Figure 1A:
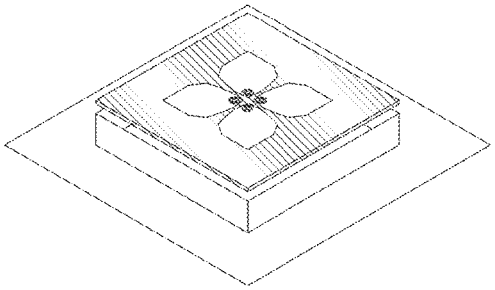
FIG. 1A is the overview of each antenna element.
Figure 1B:
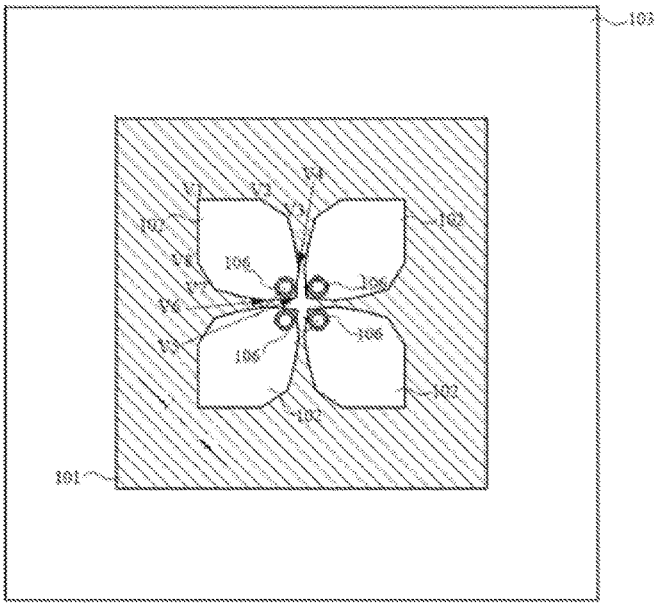
FIG. 1B is a top view of the antenna.
Figure 1C:
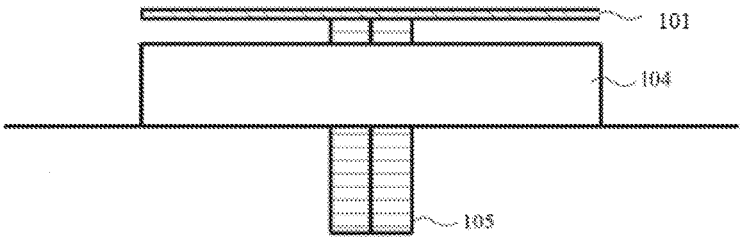
FIG. 1C is a cross-sectional view of the antenna.

FIGS. 1A, 1B and 1C describe the antenna in different views. The antenna includes: radiating elements 102, ground plane 103, metallic walls 104, coaxial cables 105, split-ring slots 106.

The antenna includes the radiating elements 102 etched on the dielectric substrate 101. The radiating elements are four petals copper flower-shaped patches printed on the dielectric substrate 101. The four petals are identical, generated by a 90° rotation around the axis perpendicular to the substrate plane. Each petal is bounded by a polygon having vertices V1-V8. Initially, V1-V8 are the vertices of the polygon inscribed in a circle having the diameter of V1-V5 distance. The position of each vertex is optimized to obtain the best impedance matching and operating bandwidth. Thanks to the optimized shape, the antenna is composed of multi-segments corresponding to many resonant frequencies.

The dielectric substrate 101 is made of Rogers RO5880 with the low relative permittivity and loss tangent ($\varepsilon_r$=2.2, tan $\delta$=0.0009). Moreover, for reducing dielectric loss, the thickness of the substrate (t) is also small.

The height between the printed-circuit board and the ground plane 103 is initially assigned of a quarter wavelength at the center frequency ($\lambda_c/4$) of the operating frequency band (i.e. 13 GHz). In the design progress, the height (H) is optimized to satisfy the requirements of antenna bandwidth and radiation pattern. After all, the H value is chosen of 0.27 $\lambda_c$.

The ground plane 103 is employed to focus the radiated power into perpendicular direction. Theoretically, a larger ground plane 103 results in a higher radiated power. However, if the distance between the printed-circuit board and the ground plane 103 becomes considerable, the current density on the ground plane 103 is small and it is reasonable to reduce ground size.

Additionally, to avoid the distortion of antenna radiation patterns at high frequencies, metallic walls 104 are perpendicularly built to the ground plane, forming a cavity enclosed in the space under the printed-circuit board antenna. The cavity height $H_w$ is figured out to be 0.2 $\lambda_c$.

Figure 2:
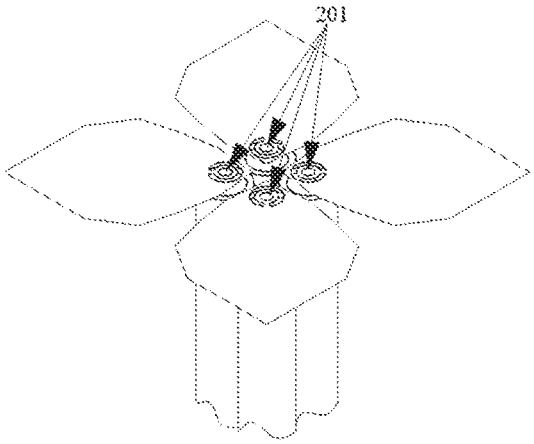
FIG. 2 is the feed parts for radiating elements of the antenna wherein the dielectric substrate is invisible for more clarity.

Referred to FIG. 2, the coaxial cables 105 are employed to feed the antenna. The cables 105 penetrate through the ground plane 103 and the substrate 101. Inner conductors of the coaxial cables 105 connect to the radiating elements 102 on the printed-circuit board.

The antenna is dual-polarized provided that it is fed in pairs of opposite petals (two petals forming an angle of 180 degree).

In this case, the signals propagating along the corresponding coaxial cable must be out-of-phase (or 180-degree different).

The feed point in each radiating element 102 is surrounded by a split-ring slot 106. The signal from the coaxial cable 105 is impeded by the slot 106 creating more inductance before flowing into the antenna. The longer the gap of the slot 106 is, the more inductance it provides. The inductance cancels out the intrinsic capacitance of the radiating elements 102, hence, the imaginary of the impedance of the antenna Im($Z_{ant}$) decreases, leaving real part Re($Z_{ant}$) of that closer to the characteristic impedance $Z_0$ of the system. Therefore, the antenna is better impedance matched, thus, has a better reflection coefficient.

The fractional bandwidth that is defined as the following formula:

$$\% BW = \frac{f_{max} - f_{min}}{f_{max} + f_{min}} \times 2 \times 100\%$$

where $f_{max}$ and $f_{min}$ are respectively the lowest and highest frequencies at which the reflection coefficients are lower than a desired value (ex. −10 dB).

Figure 3:
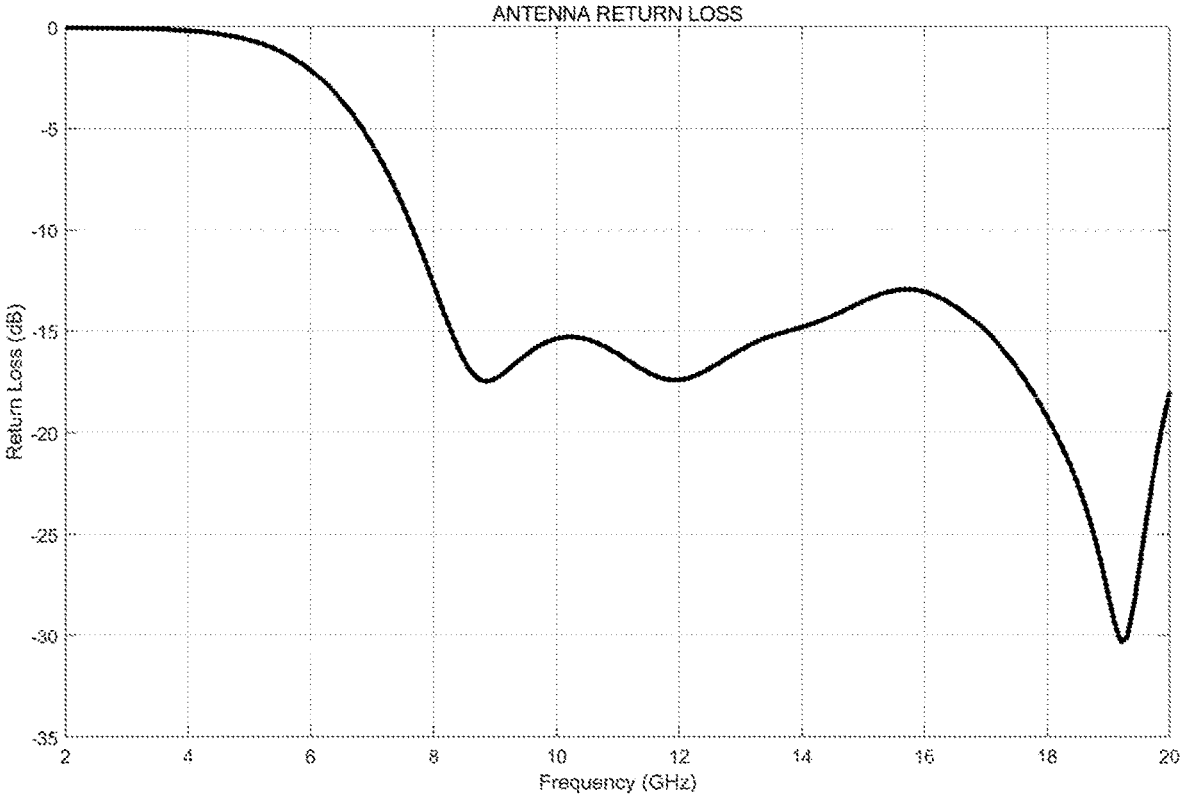
FIG. 3 is the reflection coefficient of the antenna.

FIG. 3 presents the antenna reflection coefficient. In the regime between $f_{min}$=8 GHz and $f_{max}$=18 GHz, the antenna possesses the reflection coefficient better than −10 dB, resulting in a fractional bandwidth greater than 75%.

Figure 4:
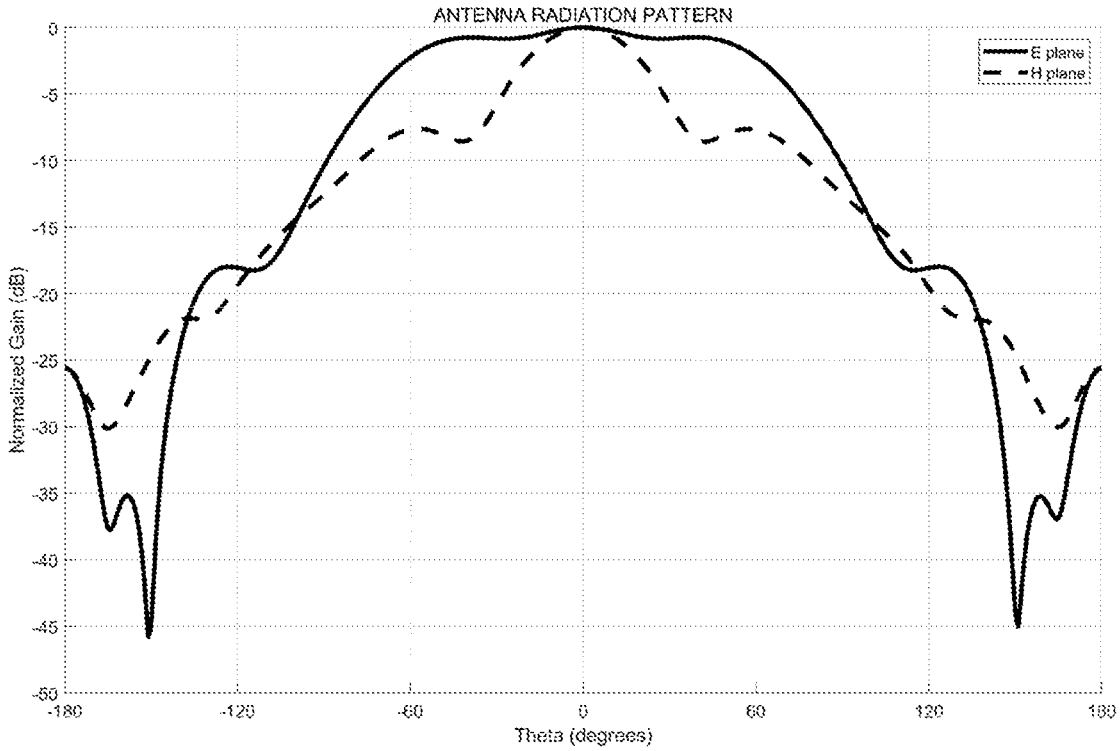
FIG. 4 is a 2D plot of the antenna radiation pattern.

At frequencies below 18 GHz, the radiation pattern of the antenna is depicted in FIG. 4. However, at frequencies higher than 18 GHz, the pattern is distorted with multiple sidelobes. Hence, the antenna is not ideal above 18 GHz, despite its good impedance-matching level, so the preferred use is below 18 GHz.

An antenna with the above technical descriptions has a good reflection coefficient and radiation pattern in the range from 8 GHz to 18 GHz. The following table describes an example of antenna with such specifications, thus, the antenna works well in the system.

The details of the antenna are listed in the Tab. 1 below

| Coordinates of the vertex of the radiating elements (unit: mm) | | | | | | | |
|---|---|---|---|---|---|---|---|
| V1V2 | V2V3 | V3V4 | V4V5 | V5V6 | V6V7 | V7V8 | V8V1 |
| 4.2 | 2.1 | 3.9 | 1.9 | 1.9 | 3.7 | 2.1 | 4.2 |
| Dimensions of the antenna (unit: mm) | | | | | | | |
| L | $L_g$ | F | s | D | H | $H_w$ | t |
| 25 | 40 | 3.15 | 0.2 | 0.51 | 6.4 | 4.5 | 0.508 |

Where:

L is the length of the substrate 101;

$L_g$ is the length of the ground plane 103;

F is the distance between the two feed point of the pair;

s is gap of the split-ring slot 106;

D is the diameter of the split-ring slot 106;

H is the height from the ground plane 103 to the substrate 101;

$H_w$ is the height of the metallic wall 104;

T is the thickness of the substrate 101.

The antenna elements can be used in a different fashion that multiple elements be employed in an array configuration to provide required gain and radiation pattern for the systems. The radiation pattern of the array depends on the number of the antenna. Each element has its maximum gain of 7.5 dBi.

Figure 5:
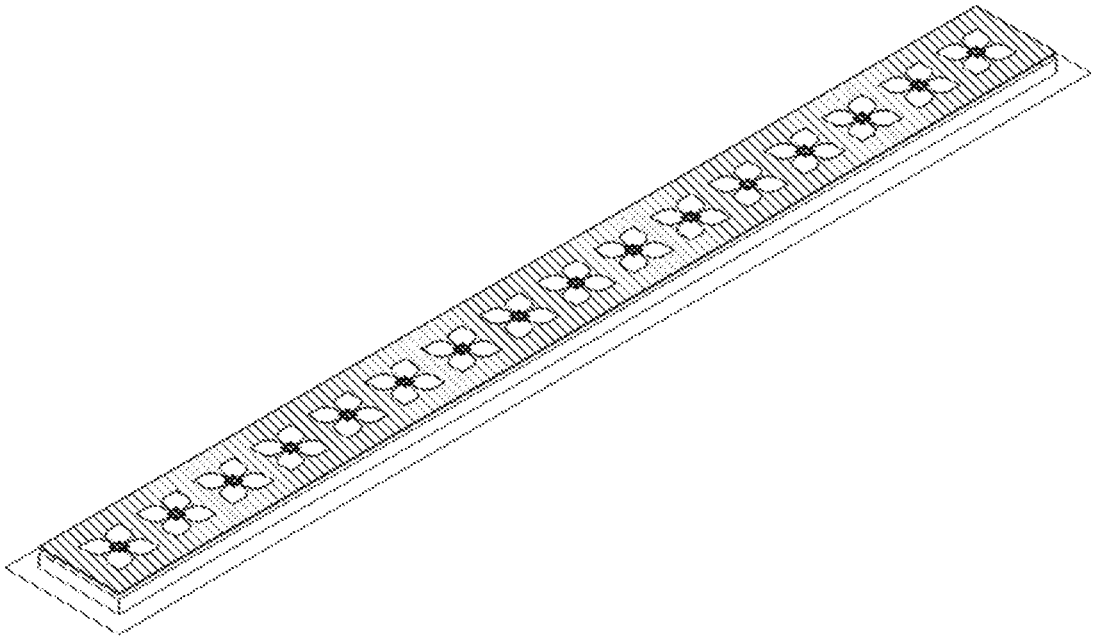
FIG. 5 depicts how to create a 16-by-1 antenna array from elements.

FIG. 5 describes a 16-element array configured in columning matrix. The array has a single cavity which has extended walls to cover all of its elements. Such an array provides a maximum gain of 15 dBi.

The number of elements can increase arbitrarily, however, this change causes the unwanted sidelobes that distort the radiation pattern. Hence, consideration must be carefully taken to trade off the array's radiation pattern with sidelobe levels.

We claim:

1. A dual-polarized wideband antenna with split-ring slots surrounding feed points, comprising: four identical radiating elements, ground plane, metallic walls, coaxial cables, split-ring slots, which are configured such that:

the four identical radiating elements are etched on a face of a printed-circuit board using a thin substrate material with low permittivity and dielectric loss ($\varepsilon_r$=2.2, tan $\delta$=0.0009);

the four identical radiating elements are placed above the ground plane with a height of a quarter wavelength of a centre frequency of an operating band of the antenna;

the metallic walls are raised perpendicular to the ground plane forming a cavity below the four identical radiating elements with an optimum height of 0.2 wavelength of the centre frequency;

the coaxial cables penetrating through the ground plane and the substrate material to feed the antenna by connection of separate ones of said coaxial cables to each of the four identical radiating elements;

an inner conductor of the coaxial cables connecting to the respective radiating elements;

the split-ring slots surroundine the feed points.

2. A dual-polarized wideband antenna according to claim 1, with optimum dimensions listed below:

wherein the antenna is fed in pairs of opposite radiating elements at the feed points of the radiating elements;

wherein each radiating element of the radiating elements is shaped as a polygon having eight vertices, V1, V2, V3, V4, V5, V6, V7 and V8, said vertices numbering in clockwise fashion beginning with V1 being the most distal from a connection location of an individual one of said coaxial cables to respective radiating element, wherein the coordinates of the vertex of the radiating elements are: V1V2=4.2 mm, V2V3=2.1 mm, V3V4=3.9 mm, V4V5=1.9 mm, V5V6=1.9 mm, V6V7=3.7 mm, V7V8=2.1 mm, V8V1=4.2 mm;

and a length of the substrate material of 25 mm; a length of the ground plane of 40 mm; a distance between two said feed points of a pair of the radiating elements of 3.15 mm; a gap of the split-ring slot of 0.2 mm; a diameter of the split-ring slot of 0.51 mm; a spacing between the radiating elements and the ground plane of 6.4 mm; the metallic-wall height of 4.5 mm; a thickness of the substrate material of 0.508 mm.

3. A dual-polarized wideband antenna according to claim 2 employed as an element in an array to synthesize a particular radiation pattern; the array using plural said elements in a row and column configuration.

4. A dual-polarized wideband antenna according to claim 3 wherein said metallic walls extend around all said plural elements.

5. A dual-polarized wideband antenna according to claim 2 employed as an element in row of plural said elements.

6. A dual-polarized wideband antenna according to claim 5 wherein the number of said plural elements is 16.

7. A dual-polarized wideband antenna according to claim 5 wherein said metallic walls extend around all said plural elements.

8. A dual-polarized wideband antenna according to claim 1 employed as an element in an array to synthesize a particular radiation pattern; the array using plural said elements in a row and column configuration.

9. A dual-polarized wideband antenna according to claim 8 wherein said metallic walls extend around all said plural elements.

10. A dual-polarized wideband antenna according to claim 1, wherein the substrate material comprises Rogers RO5880.

11. A dual-polarized wideband antenna according to claim 1 employed as an element in a row of plural said elements.

12. A dual-polarized wideband antenna according to claim 11 wherein the number of said plural elements is 16.

13. A dual-polarized wideband antenna according to claim 11 wherein said metallic walls extend around all said plural elements.

14. A dual-polarized wideband antenna according to claim 1, wherein the walls define an enclosed space under the printed-circuit board.

15. A dual-polarized wideband antenna according to claim 1, wherein the radiating elements are arranged as 4 parts in a cruciform, flower petal arrangement.

16. A dual-polarized wideband antenna according to claim 1, wherein the radiating elements are etched only on a top face of the printed-circuit board.

17. A dual-polarized wideband antenna according to claim 1, wherein the radiating elements comprise copper elements.

* * * * *